US011205550B2

(12) United States Patent
Pettersen et al.

(10) Patent No.: US 11,205,550 B2
(45) **Date of Patent: *Dec. 21, 2021**

(54) LINKAGE FOR FUSE SWITCH

(71) Applicant: Eaton Intelligent Power Limited, Dublin (IE)

(72) Inventors: Gordon Stanley Pettersen, Greenwood, SC (US); Jeeva Jayaraman, Greenwood, SC (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/834,263

(22) Filed: Mar. 30, 2020

(65) Prior Publication Data

US 2020/0227219 A1 Jul. 16, 2020

Related U.S. Application Data

(63) Continuation of application No. 15/644,099, filed on Jul. 7, 2017, now Pat. No. 10,607,795.

(60) Provisional application No. 62/465,991, filed on Mar. 2, 2017.

(51) Int. Cl.

| | |
|---|---|
| ***H01H 21/16*** | (2006.01) |
| ***H01H 21/04*** | (2006.01) |
| ***H01H 21/22*** | (2006.01) |
| ***H01H 9/10*** | (2006.01) |
| ***H01H 31/10*** | (2006.01) |
| *H01H 23/10* | (2006.01) |
| *H01H 9/28* | (2006.01) |
| *H01H 9/26* | (2006.01) |

(52) U.S. Cl.

CPC ..... *H01H 21/165* (2013.01); *H01H 9/10* (2013.01); *H01H 21/04* (2013.01); *H01H 21/22* (2013.01); *H01H 31/10* (2013.01); *H01H 9/26* (2013.01); *H01H 9/281* (2013.01); *H01H 21/16* (2013.01); *H01H 23/10* (2013.01); *H01H 2009/265* (2013.01)

(58) Field of Classification Search

None

See application file for complete search history.

(56) References Cited

U.S. PATENT DOCUMENTS

| | | | |
|---|---|---|---|
| 1,291,667 | A | 1/1919 | Ball et al. |
| 2,178,600 | A | 11/1939 | Millermaster |
| 9,224,548 | B2 | 12/2015 | Dunker |

*Primary Examiner* — Felix O Figueroa

(74) *Attorney, Agent, or Firm* — Squire Patton Boggs US LLP

(57) ABSTRACT

A rotatable switching member includes a support bracket having a first arm, a second arm, and a middle portion, and a switch flange. The rotatable switching member further includes a switch bracket connected to the middle portion of the support bracket having an attachment portion and an engagement portion. A handle is fixed to the first arm of the support bracket to rotate the rotatable switching member.

20 Claims, 7 Drawing Sheets

100
100
110
145
125
105
115
130

140
150
135
120
A 5
100
110
180
215
5

110
230
220
235
225
A
235

LINKAGE FOR FUSE SWITCH

CROSS-REFERENCE TO RELATED APPLICATION

This application is a continuation of U.S. patent application Ser. No. 15/644,099, filed on Jul. 7, 2017, which in turn claims priority to U.S. Provisional Patent Application No. 62/465,991, filed on Mar. 2, 2017. The disclosure of these documents are incorporated by reference herein in their entirety.

FIELD OF INVENTION

The present disclosure relates to linkages configured to engage fuse switches located within serviceable busway plugs. More specifically, the present disclosure relates to linkages for manipulating hinged switches within a serviceable busway plug.

BACKGROUND

Busway installations consist of several pieces of bus duct that are connected together with bridge joints. Along the busways, serviceable busway plugs (also referred to as "serviceable plugs") are provided to enclose electrical connections between the phases of a busway and downstream electrical equipment that draw power from the busway phases. The serviceable plug often incorporates additional protection devices, such as fuses or circuit breakers, to protect and control downstream equipment. Serviceable busway plugs allow for end users to make connections inside of the busway plug housing to customize the wiring.

Serviceable busway plugs often include fuse boxes having fuse switches and fuses, which are electrically connected to the phases of a busway and to downstream equipment through power cables. The power cables are attached to an output of the fuse switches within the serviceable busway plug, and the phases of a busway are connected to an input of the fuse switches. A user can selectively open or close the circuit to the downstream equipment by activating the fuse switch. In known systems, a bell or bracket is located inside of the serviceable busway plug that engages with the fuse switch inside of the serviceable busway plug housing. The bell or bracket is further connected to a lever located on an exterior of the housing. A user can manipulate the fuse switch by moving the lever back and forth, and thus can open or close the electrical connection without opening the serviceable busway plug Fuse switches have different geometries, depending on the manufacturer and power rating. Some fuse switches include non-standard design features that prevent a conventional bell or bracket from being capable of engaging the switch safely and reliably. Thus, a need exists for a structure capable of engaging with fuse switches having unconventional design features, which can safely and reliably open or close the fuse switch.

SUMMARY

In one embodiment, a busway plug has a housing, a fuse box mounted within the housing, one or more fuse switches connected to the fuse box, and a rotatable switching member rotatably mounted to the housing. The rotatable switching member has a first engagement part configured to engage with a first surface of the fuse switch when the rotatable switching member is rotated in a first direction, and a second engagement part configured to engage with a second surface of the fuse switch when the rotatable switching member is rotated in a second direction opposite the first direction. The second engagement part includes a plurality of projections that are configured to engage with the second surface of the fuse switch. The fuse switch may further include a loop on the second surface, and the projections may be teeth. Adjacent teeth may be spaced a first distance apart, the first distance being sufficient to receive a loop of the second surface. The rotatable switching member may further include a curved flange adjacent to the second engagement part. The busway plug may further include a lever fixed to the rotatable switching member and rotatable with respect to the housing. The rotatable switching member may include a cutout portion wherein the first engagement part is located within the cutout portion. The fuse switch may be non-standard. The rotatable switching member may be configured to rotate 110°.

In another embodiment, a rotatable switching member comprises a support bracket configured to rotate 110° and the support bracket has a first arm, a second arm having a through hole, a middle portion, and a switch flange extending from the middle portion. The rotatable switching member further has a switch bracket connected to the support bracket, wherein the switch bracket includes an attachment portion and an engagement portion. The rotatable switching member further comprises a pin extending through the through hole of the second arm and a handle fixed to the first arm of the support bracket. The support bracket may further include a curved flange adjacent to the switch bracket. The switch flange and engagement portion of the switch bracket may be configured to engage with opposing sides of a fuse switch. The switch bracket engagement portion may include one or more teeth. The switch bracket may include a plurality of teeth of at least two different sizes, and the plurality of teeth may be configured to contact a lower surface of a fuse switch. Two adjacent teeth may be spaced to receive a loop between the two adjacent teeth.

In yet another embodiment, a busway plug includes a housing, a fuse box mounted within the housing, and a plurality of fuse switches connected to the fuse box. The busway plug further includes a rotatable switching member rotatably mounted to the housing. The rotatable switching member has a first engagement part and a second engagement part. The second engagement part has a plurality of projections, each of the plurality of projections being configured to engage with one of the plurality of fuse switches.

BRIEF DESCRIPTION OF THE DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figures 1A, 1B:
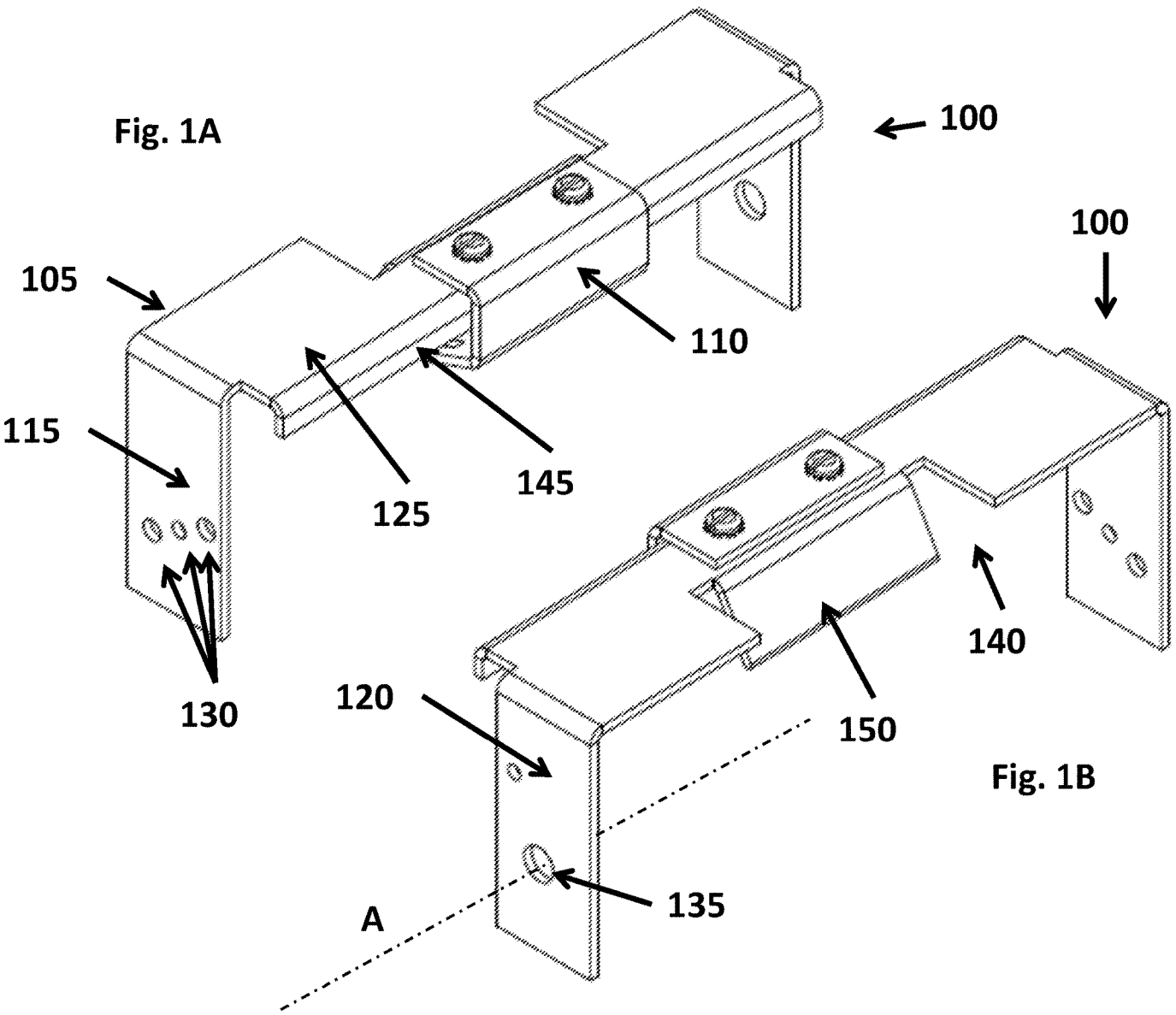
FIG. 1A is a perspective view of a rotatable switching member in accordance with an embodiment of the present disclosure.
FIG. 1B is a reverse perspective view of the rotatable switching member of FIG. 1A.

FIGS. 1A and 1B are perspective views of switching member 100 according to an embodiment of the present disclosure. The switching member 100 is configured to be employed with fuse switches in a serviceable busway, and includes two main components: a support bracket 105 and a switch bracket 110. Support bracket 105 in this embodiment is generally U-shaped, having a first arm 115, a second arm 120, and a middle portion 125 extending from the first arm to the second arm.

First arm 115 includes a plurality of through-holes 130 sized and shaped to receive fasteners to attach a lever or handle to first arm 115. Second arm 120 has a pivot hole 135 sized and shaped to receive a bolt or pin that also extends through a serviceable bus plug housing. Pivot hole 135 defines an axis of rotation A about which switching member 100 can rotate when the bolt or pin is installed. In alternative embodiments (not shown), the size, number, and location of the holes may be varied to accommodate structure of the fuse switches or the serviceable busway.

Middle portion 125 of support bracket 105 is generally rectangular, but includes a cutout portion 140 on a first arm and a curved flange 145 extending from a second arm. The dimensions of the cutout portion 140 and curved flange 145 may be selected based on a variety of factors, including the dimensions of a fuse switch with which the switching member 100 will be used, structural integrity and endurance factors, and form factors of the busway plug housing in which the switching member 100 is used.

Support bracket 105 further includes a switch flange 150 extending at an angle from an interior of the cutout portion 140. The switch flange 150 extends downwards from the middle portion 125, relative to the orientation of support bracket 105 in FIG. 1B. Switch flange 150 is sized and shaped to interact with the fuse switch.

In other alternative embodiments (not shown) switch flange can take other forms, such as a trapezoidal shape or a zig-zag shape.

Figure 2A:
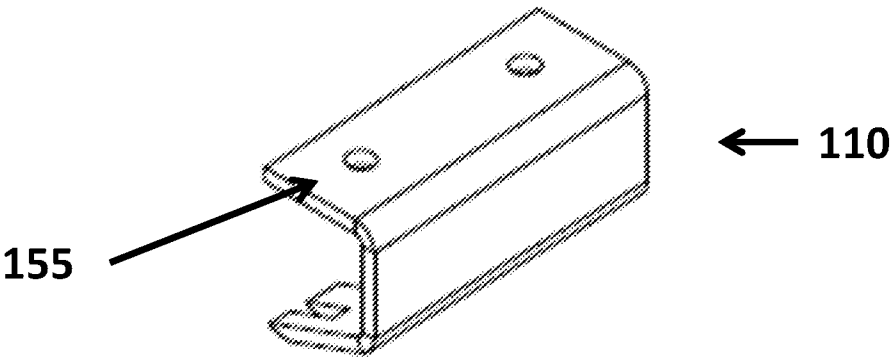
FIG. 2A is a perspective view of a switching bracket according to the embodiment of FIGS. 1A and 1B.
Figure 2B:
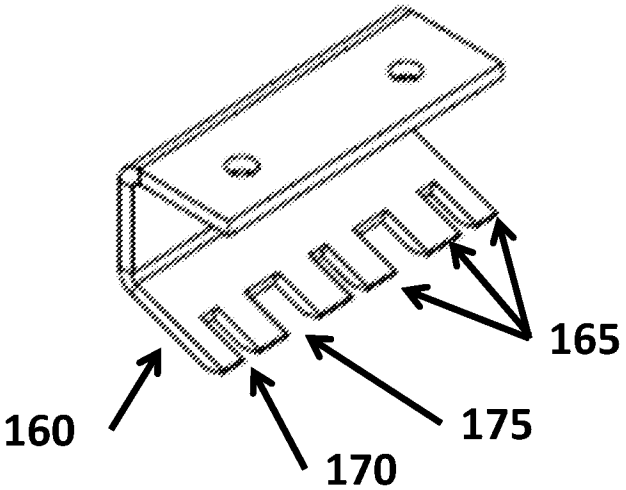
FIG. 2B is a reverse perspective view of a switching bracket according to the embodiment of FIGS. 1A and 1B.

FIGS. 2A and 2B show perspective views of the switch bracket 110. Switch bracket 110 has an attachment portion 155 and an engagement portion 160. In the illustrated embodiment, the attachment portion 155 of the switch bracket 110 includes a pair of apertures configured to receive two screws. The screws are also received by corresponding apertures in the support bracket 105 for mounting the switch bracket 110 to the support bracket 105 in the manner shown in FIG. 1.

In alternative embodiments (not shown), the switch bracket can be fastened to the support bracket using other means, such as by welding, chemical bonding, adhesion, pins, bolts, or any other mechanical fastener. In alternative embodiments (not shown), the switch bracket and support bracket can be formed as a single integral piece, or more than two pieces fastened together.

Engagement portion 160 of switch bracket 110 has a comb-like surface with a plurality of projections (or teeth) 165, small gaps 170, and large gaps 175. The comb-like surface allows for the engagement portion 160 of the switch bracket 110 to engage with an irregular surface of a fuse switch (not shown). The teeth 165 in this embodiment are rectangular in shape.

In alternative embodiments (not shown), teeth can have different shapes, such as rounded or pointed shapes. In other alternative embodiments (not shown), teeth may be omitted, and the engagement portion of the switch bracket can instead take any irregular shape that engages with a fuse switch. The size and number of the teeth and gaps may be varied to accommodate the structure of a given fuse switch.

Figure 3B:
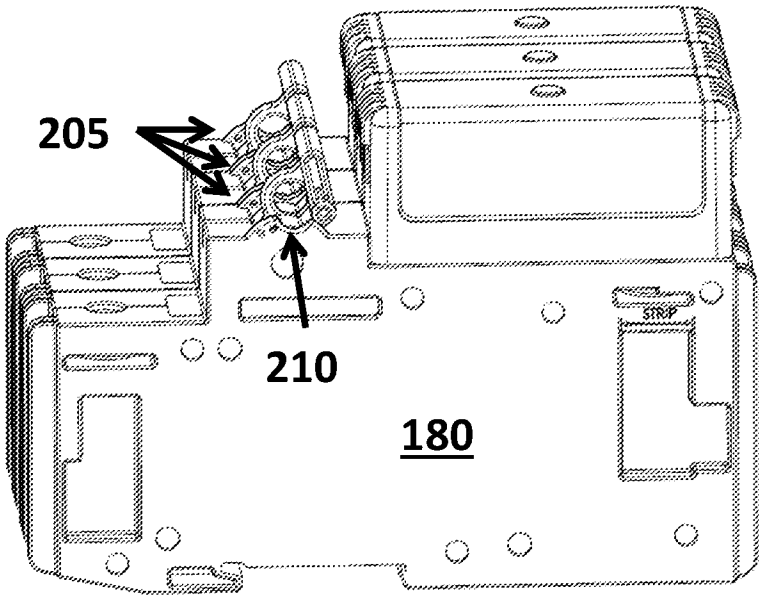
FIG. 3B is a perspective view of the fuse box shown in FIG. 3A.
Figure 3A:
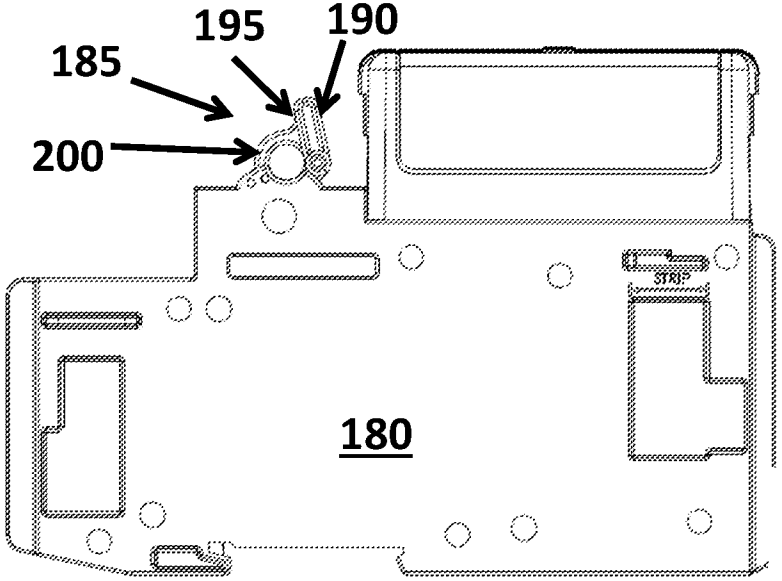
FIG. 3A is a side view of a fuse box having fuse switches for use with the rotatable switching member of FIGS. 1A and 1B.

FIG. 3A shows a fuse box 180 (or compact circuit protector "CCP") with fuse switches 185, having upper switch surfaces 190, lower switch surfaces 195, and one or more loops 200 extending from the lower switch surfaces 195. FIG. 3B shows the fuse box 180 and fuse switches 185 from a perspective angle. The fuse box 180 further includes a plurality of semicircular protrusions 205, each having a crescent cutout portion 210. As seen in FIG. 3A, the crescent cutout portions 210 align with the loops 200 when the fuse switches 185 are in the open position, and have similar radii of curvatures. The small gaps 170 of the engagement portion 160 of switch bracket 110 are sized to match the thickness of loops 200, so that the small gaps 170 fit over the loops 200. The large gaps 175 are sized to match the thickness of the semicircular protrusions 205, so that the large gaps 175 can fit over the semicircular protrusions 205. With the gaps 170, 175 so aligned, teeth 165 come into contact with the lower switch surface 195. By providing teeth 165, the contact surface area between switch bracket 110 and lower switch surface 195 is increased.

In alternative embodiments (not shown), the semicircular protrusions may take other shapes, such as rectangular or trapezoidal. In other alternative embodiments (not shown), loops may be omitted, and the fuse switch lower switch surface 195 may take any form. In other alternative embodiments (not shown), the loops and cutout portions of the protrusions may take any shape, such as a rectangular or trapezoidal shape. In other alternative embodiments (not shown), the semicircular protrusions may be sized to fit within small gaps and the loops may be sized to fit within large gaps. In other alternative embodiments (not shown), both the semicircular protrusions and the loops may be sized to fit within similarly sized gaps.

The loops 200 of the fuse switches 185 are configured to receive a locking mechanism, such as a rod (not shown) therethrough, which prevents inadvertent closing of the fuse switch during maintenance or downtime, for example. The design of semicircular protrusions 205 and crescent cutout portions 210 permit a user to insert the locking mechanism through the loops 200 when loops are aligned with the crescent cutout portions 210, in the configuration shown in FIG. 3.

Figures 4A, 4B:
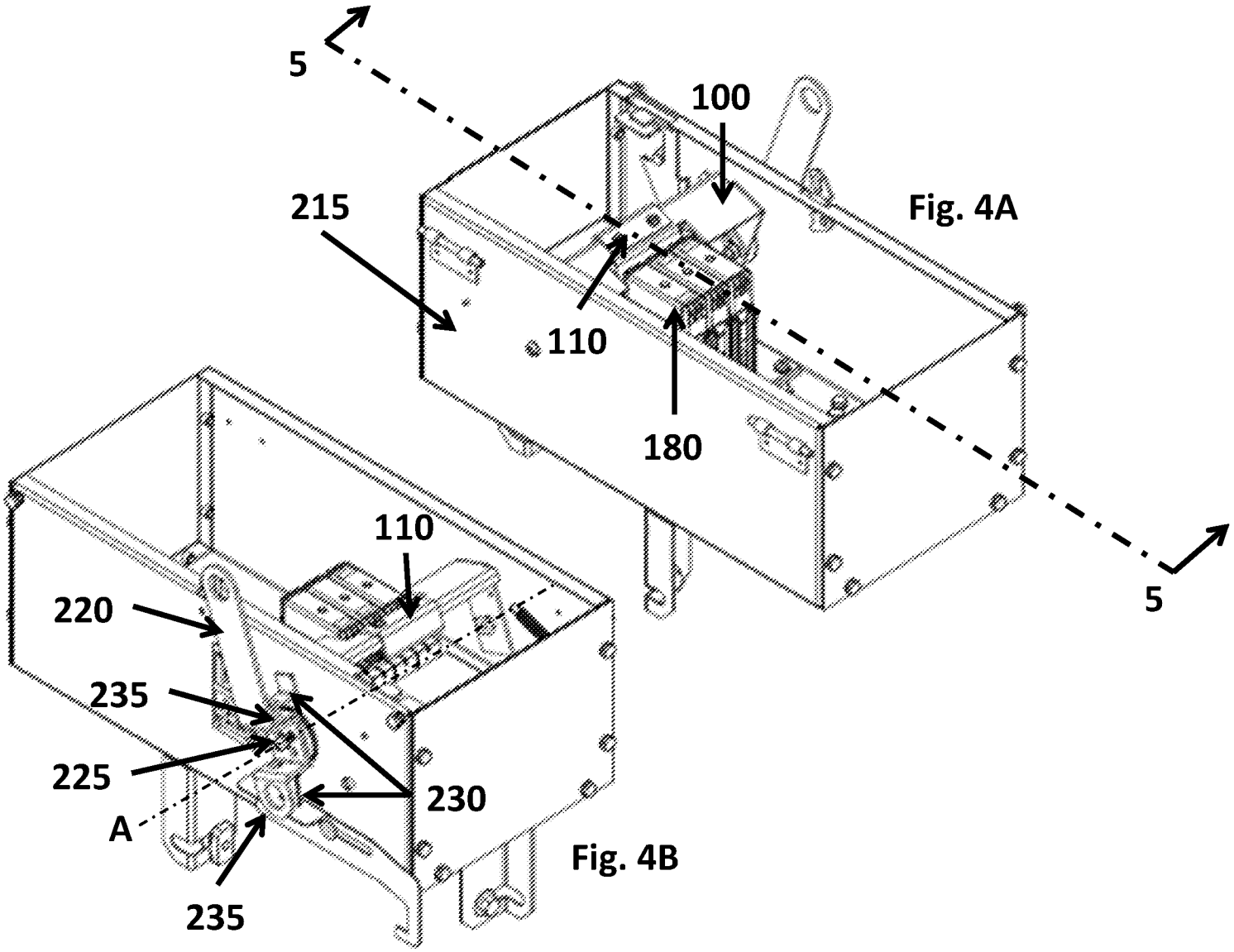
FIG. 4A is a perspective view of a busway plug housing for use with the rotatable switching member of FIGS. 1A and 1B and the fuse box of FIGS. 3A and 3B.
FIG. 4B is a reverse perspective view of FIG. 4A.

FIGS. 4A and 4B are perspective views of an exemplary serviceable busway plug housing 215 having the top removed, for use with the switching member 100 and fuse box 180. As can be seen in FIGS. 4A and 4B, the switching member 100 is engaged with the fuse switch 185, and connected to lever 220. Pin 225 extends into the pivot hole 135 of second arm 120 of support bracket 105 and further extends through serviceable busway plug housing 215, permitting a rotational movement about axis of rotation A.

Serviceable busway plug housing 215 further may include one or more housing locking flanges 230 that are arranged to align with corresponding lever locking flanges 235 of lever 220. A user can insert a locking device (not shown) through both housing locking flanges 230 and lever locking flanges 235 to prevent lever 200 from moving into an "on" position, where the fuse switch 185 is in a closed position. A user may perform this locking during, for example, a maintenance procedure.

Figure 5:
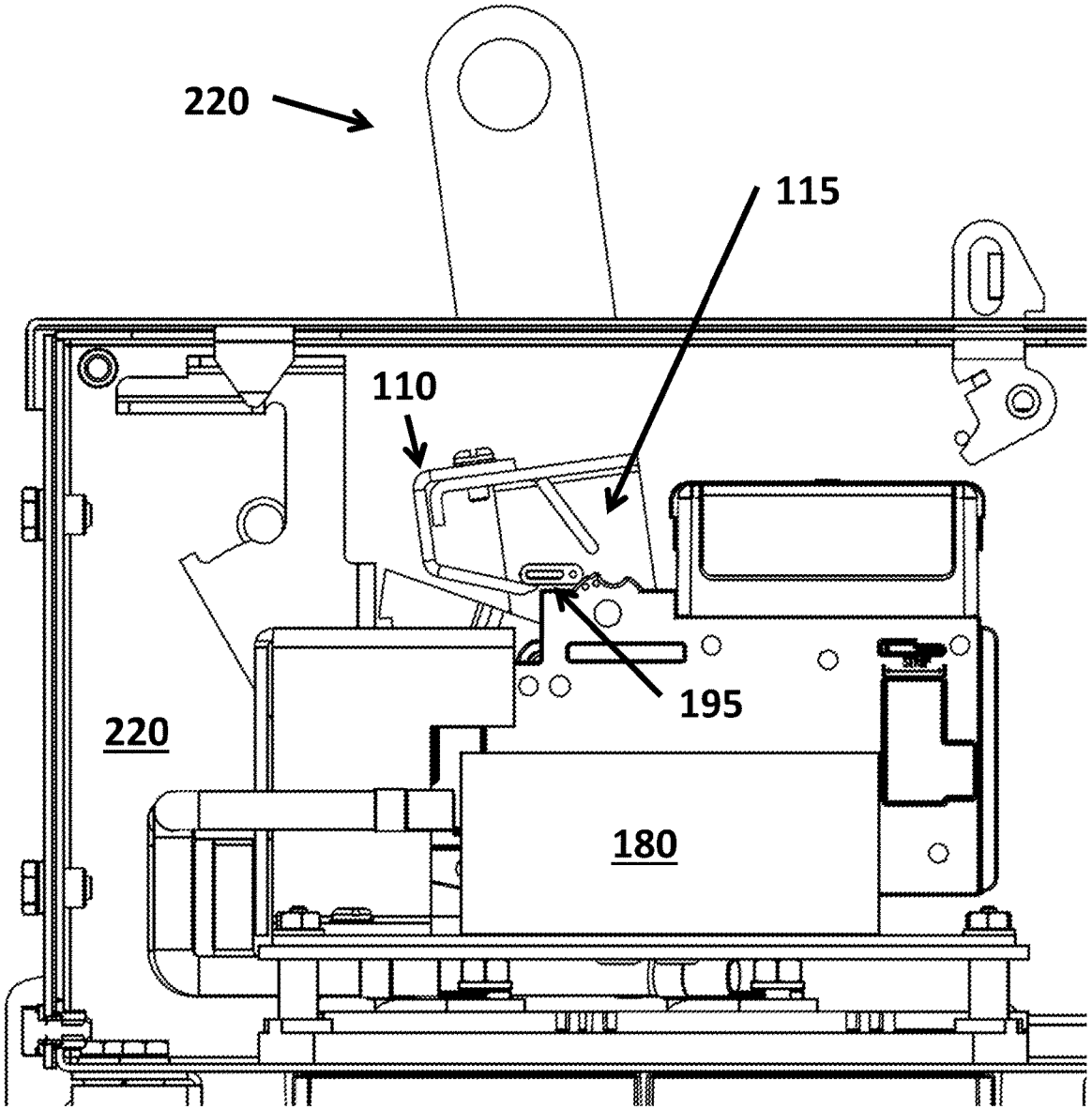
FIG. 5 is a detailed partial cross section view of the busway plug housing of FIG. 4A along line 5-5, with the fuse switches in a closed position.

FIG. 5 shows a detailed partial cross section view of the exemplary serviceable busway plug housing 215 along line 5-5 of FIG. 4A. Serviceable busway plug housing 215 contains the fuse box 180, fuse switches 185 and switching member 100. Lever 220 is affixed to the support bracket first arm 115 via one or more mechanical fasteners (not shown). The fuse switches 185 are shown in the closed position in FIG. 5, and loops 200 are not exposed in this position. The switch bracket 110 is positioned to contact the lower switch surface 195 in this position, without contacting any other component within serviceable busway plug housing 215. When a user pulls lever 220, support bracket 105 rotates, causing switch bracket 110 to rotate, and switch bracket teeth 165 engage with lower switch surface 195 to push fuse switches 185 into an open position. The small and large gaps 170, 175 fit around the loops 200 and semicircular protrusions 205, respectively, as the switch bracket 110 moves the fuse switches 185 into the open position.

In alternative embodiments (not shown), the lever can be omitted and replaced with any other device for rotating the switching member, such as a knob or rack and pinion.

Figure 6:
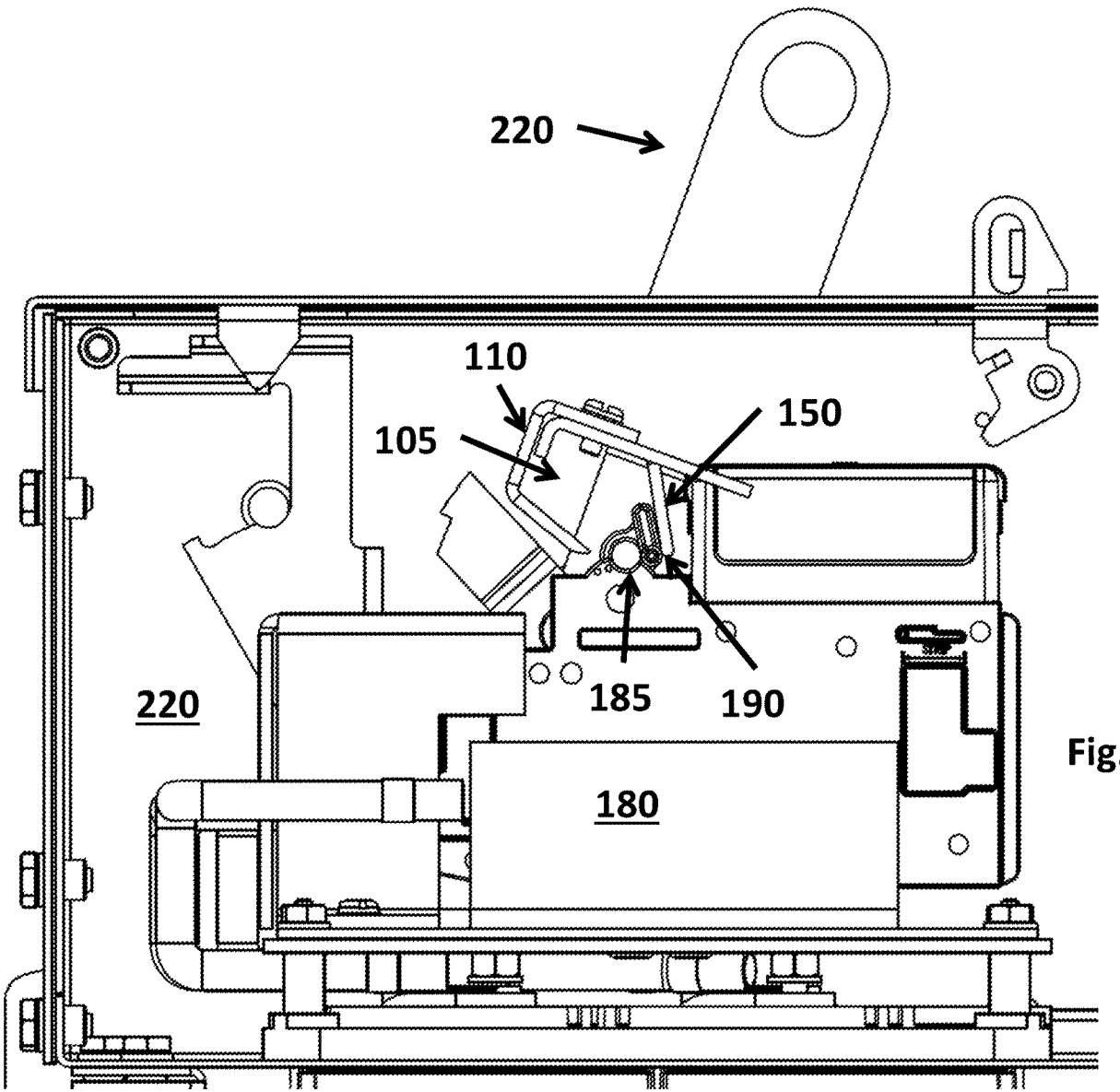
FIG. 6 is a detailed partial cross section view of the busway plug housing of FIG. 4A along line 5-5, with the fuse switches in an open position.

FIG. 6 shows the same view of the serviceable busway plug housing 215 as in FIG. 5, except that in FIG. 6 the fuse switches 185 are shown in an open position, and lever 220 and switching member 100 have been rotated. As seen in FIGS. 5 and 6, the fuse switches 185 rotate approximately 110° between the open and closed positions, which is an unusual rotational distance. Typical fuse switches rotate less than 110° between open and closed positions, and have no obstructions immediately adjacent to the fuse switch. Fuse switches 185 further are not easily accessible because fuse box 180 has a geometry that is not conducive for use with conventional switching linkages. Switching member 100 thus provides a solution for switching fuse switches that rotate a greater than normal distance between open and closed positions, and/or which are placed adjacent to geometric obstructions.

In this configuration, the switch flange 150 is in contact with the fuse switch upper switch surface 190. As seen in FIG. 6, the switch flange 150 is parallel to the upper switch surface 190, maximizing the contact area between the two. As a user rotates lever 220 back towards the position shown in FIG. 4, the lever 220 rotates the support bracket 105 and causes switch flange 150 to force the fuse switch 185 into a closed position.

Figure 7:
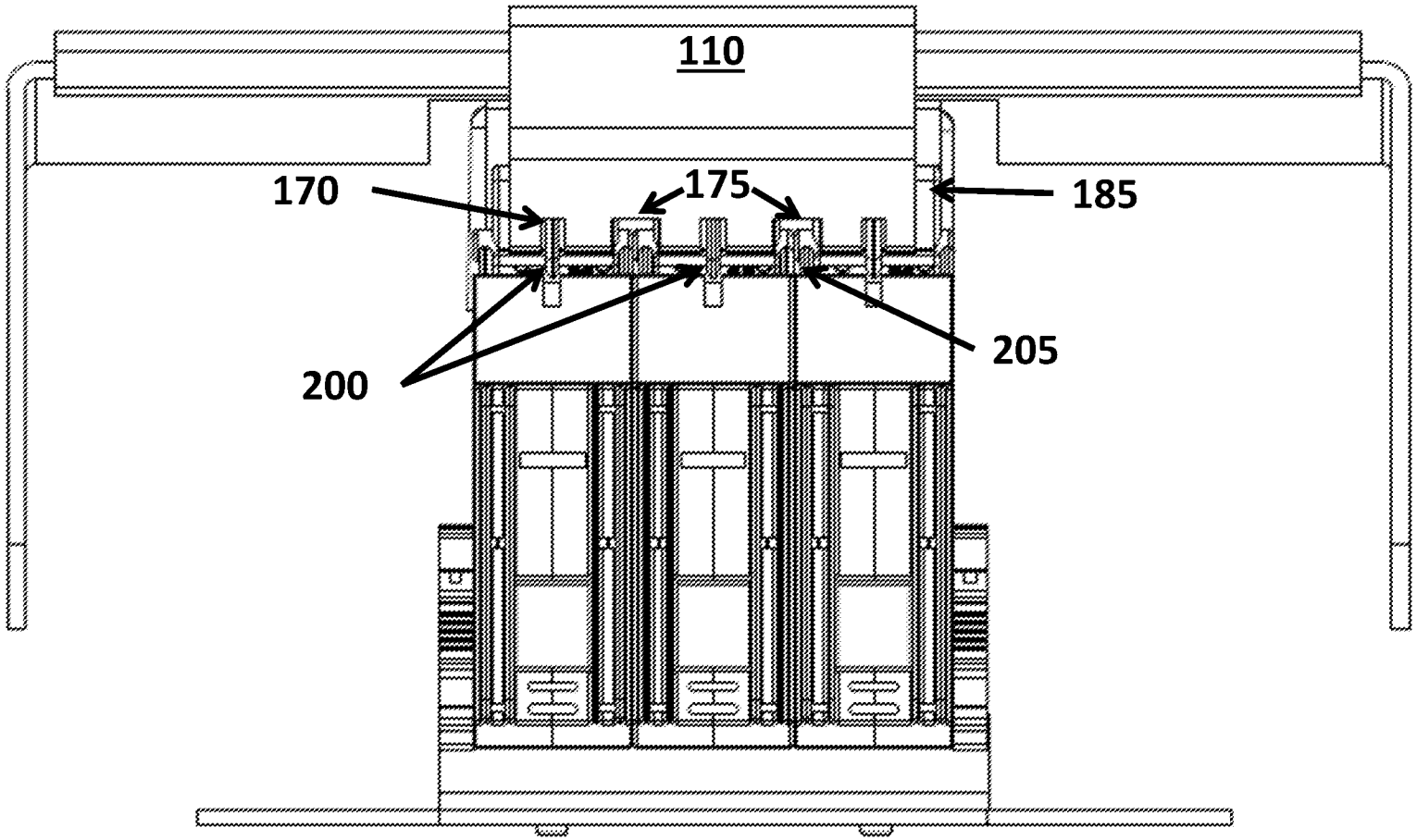
FIG. 7 is a front view of the rotatable switching member of FIGS. 1A and 1B engaged with the fuse box of FIGS. 3A and 3B.

FIG. 7 is a front view of fuse switch 185 with switch bracket 110 being engaged with the loops 200 and semicircular protrusions 205. As seen in FIG. 7, the large gaps 175 semicircular protrusions 205, and small gaps 170 receive loops 200.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present disclosure has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the disclosure, in its broader aspects, is not limited to the specific details, the representative system and method, and illustrative examples shown and described. Accordingly, departures may be made from such details without departing from the spirit or scope of the applicant's general inventive concept.

What is claimed is:

1. A busway plug comprising:

a fuse box;

at least one fuse switch connected to the fuse box;

a rotatable switching member rotatably mounted to a housing, wherein the rotatable switching member has a first engagement part and a second engagement part, wherein a plurality of teeth are directly connected to and extend outward from a single surface of the second engagement part of the rotatable switching member, wherein the plurality of teeth are configured to engage with a surface of the fuse switch, and wherein adjacent teeth are spaced apart by a distance sufficient to receive a portion of the fuse switch.

2. The busway plug of claim 1, wherein the fuse switch includes a loop.

3. The busway plug of claim 2, wherein the adjacent teeth of the second engagement part are spaced apart by a distance sufficient to receive the loop of the fuse switch.

4. The busway plug of claim 1, wherein the rotatable switching member further includes a curved flange adjacent to the second engagement part.

5. The busway plug of claim 1, further comprising a lever fixed to the rotatable switching member and rotatable with respect to the housing.

6. The busway plug of claim 1, wherein the teeth are rectangular in shape.

7. The busway plug of claim 1, further comprising a locking mechanism engaged with the fuse switch.

8. The busway plug of claim 1, wherein the rotatable switching member is configured to rotate 110° with respect to the housing.

9. A rotatable switching member for use with a busway plug, the rotatable switching member comprising:

a support bracket mounted to and rotatable with respect to a busway plug housing, wherein the support bracket has a first arm, a second arm, and a middle portion, and wherein the support bracket further has a switch flange extending from the middle portion;

a handle connected to the first arm of the support bracket; and a switch bracket connected to the support bracket, wherein the switch bracket includes an attachment portion and an engagement portion, wherein the engagement portion includes a plurality of projections configured to engage with a surface of a fuse switch, and wherein adjacent projections are spaced apart by a distance sufficient to receive a portion of the fuse switch.

10. The rotatable switching member of claim 9, wherein the switch flange is unitary with the support bracket.

11. The rotatable switching member of claim 9, wherein the switch flange and the engagement portion of the switch bracket are configured to engage with opposing sides of a fuse switch.

12. The rotatable switching member of claim 9, wherein the plurality of projections includes projections of at least two different sizes.

13. The rotatable switching member of claim 9, wherein the plurality of projections are configured to contact a lower surface of a fuse switch.

14. The rotatable switching member of claim 9, wherein two adjacent projections are spaced to receive a loop between the two adjacent projections.

15. A busway plug comprising:

a fuse box mounted in a housing;

a plurality of fuse switches connected to the fuse box;

a rotatable switching member rotatably mounted to the housing, wherein the rotatable switching member has a first engagement part and a second engagement part, wherein the second engagement part has a plurality of projections, each of the plurality of projections being configured to engage with one of the plurality of fuse switches, wherein the plurality of projections includes projections of at least two different sizes, and wherein adjacent projections are spaced apart by a distance sufficient to receive a portion of one of the plurality of fuse switches.

16. The busway plug of claim 15, wherein each of the plurality of fuse switches includes a loop.

17. The busway plug of claim 15, wherein the rotatable switching member includes a support bracket having a first arm, a second arm, and a middle portion.

18. The busway plug of claim 17, wherein the first engagement part and the second engagement part are connected to the middle portion of the support bracket.

19. The busway plug of claim 17, wherein the busway plug is a serviceable busway plug.

20. The busway plug of claim 19, further comprising a pivot pin extending through a through hole of the second arm of the support bracket and through a through hole in the housing.

* * * * *